US008783819B2

(12) United States Patent
Snyder et al.

(10) Patent No.: US 8,783,819 B2
(45) Date of Patent: Jul. 22, 2014

(54) SYSTEM AND METHOD FOR ENHANCING DETECTION OF WEAK AND MISSING INKJETS IN AN INKJET PRINTER

(75) Inventors: Trevor James Snyder, Newberg, OR (US); James Matthew Cunnington, Tualatin, OR (US)

(73) Assignee: Xerox Corporation, Norwalk, CT (US)

( * ) Notice: Subject to any disclaimer, the term of this patent is extended or adjusted under 35 U.S.C. 154(b) by 345 days.

(21) Appl. No.: 13/353,143

(22) Filed: Jan. 18, 2012

(65) Prior Publication Data

US 2013/0182029 A1 Jul. 18, 2013

(51) Int. Cl.
*B41J 29/393* (2006.01)

(52) U.S. Cl.
USPC ..... 347/19

(58) Field of Classification Search
None
See application file for complete search history.

(56) References Cited

U.S. PATENT DOCUMENTS

| | | | | |
|---|---|---|---|---|
| 6,350,012 | B1 | 2/2002 | Sarkissian et al. | |
| 7,338,144 | B2 | 3/2008 | Mantell et al. | |
| 7,427,118 | B2 | 9/2008 | Mizes et al. | |
| 2006/0114284 | A1 * | 6/2006 | Mizes et al. | 347/19 |
| 2007/0024658 | A1 | 2/2007 | Diol et al. | |
| 2010/0231635 | A1 | 9/2010 | Ramakrishnan et al. | |
| 2010/0245454 | A1 | 9/2010 | Ramakrishnan et al. | |
| 2010/0271424 | A1 | 10/2010 | Cunnington et al. | |
| 2013/0076820 | A1 * | 3/2013 | Chandu et al. | 347/14 |

* cited by examiner

*Primary Examiner* — Geoffrey Mruk
*Assistant Examiner* — Bradley Thies
(74) *Attorney, Agent, or Firm* — Maginot, Moore & Beck, LLP

(57) ABSTRACT

A method increases the ability of a controller in a printer to detect weak or missing inkjets in the printer. The method includes generating a test pattern having at least twice as much ink as a typical test pattern used to detect weak or missing inkjets. The increased ink appropriately stresses inkjets to facilitate detection of weak or missing inkjets and the test pattern is transferred to media and removed from the printer to preserve the capacity of a drum maintenance unit to store residual ink removed from an imaging drum or belt.

11 Claims, 6 Drawing Sheets

SYSTEM AND METHOD FOR ENHANCING DETECTION OF WEAK AND MISSING INKJETS IN AN INKJET PRINTER

TECHNICAL FIELD

This disclosure relates generally to devices that produce ink images on media, and more particularly, to devices that that eject ink from inkjets to form ink images.

BACKGROUND

Inkjet imaging devices eject liquid ink from printheads to form images on an image receiving member. The printheads include a plurality of inkjets that are arranged in some type of array. Each inkjet has a thermal or piezoelectric actuator that is coupled to a printhead controller. The printhead controller generates firing signals that correspond to digital data for images. The frequency and amplitude of the firing signals correspond to the selective activation of the printhead actuators. The printhead actuators respond to the firing signals by ejecting ink drops onto an image receiving member to form an ink image that corresponds to the digital image used to generate the firing signals.

Throughout the life cycle of these inkjet imaging devices, the image generating ability of the device requires evaluation and, if the images contain detectable errors, correction. Missing inkjets or weak inkjets are an error condition that affects ink image quality. A missing inkjet is an inkjet that does not eject an ink drop in response to a firing signal. A weak inkjet is an inkjet that responds intermittently to a firing signal or that responds by ejecting ink drops having a mass that is less than the ink drop mass corresponding to the characteristics of the firing signal for the inkjet. Systems and methods have been developed that compensate for missing or weak inkjets, but the missing or weak inkjets must be detected before these systems and methods can be activated.

Current detection methods include a test pattern being formed on an image receiving member and then digital data of the test pattern on the surface are generated. In an offset imaging device, the image receiving member is a rotating drum or belt. The digital data are produced by illuminating the drum or belt surface and generating an electrical signal that corresponds to the intensity of the light reflected from the surface. The signal is generated by an electro-optical sensor that is positioned to receive light reflected from a small portion of the drum or belt surface. By arranging a plurality of electro-optical sensors across the width of the drum or belt, the entire width can be used to generate reflected light received by the electro-optical sensors. The responses of the electro-optical sensors produce a digital image corresponding to the ink image on the drum or belt. The ink drops on the surface reflect light at an intensity that is different than the positions on the surface that do not have ink.

Evaluating a digital image produced by illuminating an image drum or belt can be difficult because the surface may generate noise in the digital image. Detecting the portion of the image data corresponding to ink on the drum or belt is made more difficult by the amount of ink in the test pattern. The amount of ink in test patterns is deliberately kept small since the test pattern is wiped from the drum or belt and the ink is collected by a drum maintenance unit. The drum maintenance unit includes a supply of release agent, an applicator, and a wiper. The wiper is selectively moved into and out of engagement with the image drum or belt to remove residual ink and other debris from the drum surface. The removed release agent, ink, and debris are directed to a sump within the drum maintenance unit. Because the capacity of the sump in the drum maintenance unit is relatively small, test patterns are printed with small amounts of ink. Testing has shown, however, that certain jetting failure mechanisms can only be seen repeatedly when a larger amount of ink is flowed through the failed inkjet. For example, some internal contamination particles can be suspended in the ink within the inkjet. Sometimes, a larger amount of ink must flow through the inkjet to move these suspended particles into the aperture to block the flow. Other mechanisms may be more complex, such as contaminates partially hanging out of a jet, physical aperture defects, and/or insufficient anti-wetting coatings. These mechanisms can exhibit the same behavior in that the inkjet can work correctly when a small amount of ink is ejected, but can fail when used at a higher duty cycle with a larger amount of jetted ink mass. Consequently, the failed inkjet ejection process and/or the image processing required for detection of the actual number of failed inkjets can be significant and still be susceptible to error. Improving the ability of inkjet imaging systems to detect missing and weak inkjets in an inkjet imaging system remains important to such systems.

SUMMARY

A method improves the detection of weak or missing inkjets in an inkjet printer. The method includes detecting a first number of missing inkjets identified with reference to a first test pattern is less than an actual number of missing inkjets in the inkjet printer, operating each inkjet in at least one printhead in the printer at a frequency to generate a second test pattern in a process direction on a rotating image receiving member with each inkjet being operated to eject at least twice as much ink in the second test pattern than each inkjet ejected to form the first test pattern, generating a digital image of the second test pattern on the image receiving member from light reflected by the second test pattern and the image receiving member to a plurality of light sensors linearly arranged on a first support member that is transverse to the process direction, detecting a second number of missing inkjets with reference to the generated digital image of the second test pattern, and storing an identification of the missing inkjets in the second number of missing inkjets that are not in the first number of missing inkjets detected with reference to the first test pattern to enable a controller to distribute image data corresponding to the missing inkjets in the second number of missing inkjets to operable inkjets in the printer.

Another method improves the detection of weak or missing inkjets in an inkjet printer. The other method includes operating each inkjet in at least one printhead in the printer at a frequency to generate a second test pattern in a process direction on a rotating image receiving member with each inkjet being operated to eject at least twice as much ink in the second test pattern than each inkjet ejected in a first test pattern, generating a digital image of the second test pattern on the image receiving member from light reflected by the second test pattern and the image receiving member to a plurality of light sensors linearly arranged on a support member that is transverse to the process direction, transferring the second test pattern from the rotating image receiving member to a media sheet, and operating a media transport to deliver the media sheet to a discharge area.

A printer implements the method to improve detection of missing and weak inkjets in an inkjet printer. The printer includes an image generator having a plurality of light sensors linearly arranged along a first support member that is transverse to a process direction of a rotating image receiving member, the plurality of light sensors configured to generate a digital image of ink images on the rotating image receiving member from light reflected by the ink images on the rotating image receiving member, a plurality of printheads operatively connected to a second support member to position the printheads in the plurality of printheads across a width of the rotating image receiving member, an actuator coupled to the second support member, the actuator being configured to move the second support member transversely to the process direction to move the printheads in a cross-process direction across the width of the rotating image receiving member, and a controller operatively connected to the image generator, the plurality of printheads, and the actuator, the controller configured to operate the printheads in the plurality of printheads to form a first test pattern on the rotating image receiving member and to operate the printheads in the plurality of printheads to form a second test pattern on the rotating image receiving member, the second test pattern having at least twice as much ink as the first test pattern.

BRIEF DESCRIPTION OF THE DRAWINGS

The foregoing aspects and other features of a system and method that improve detection of missing and weak inkjets in inkjet printers are explained in the following description, taken in connection with the accompanying drawings.

DETAILED DESCRIPTION

Figure 1:
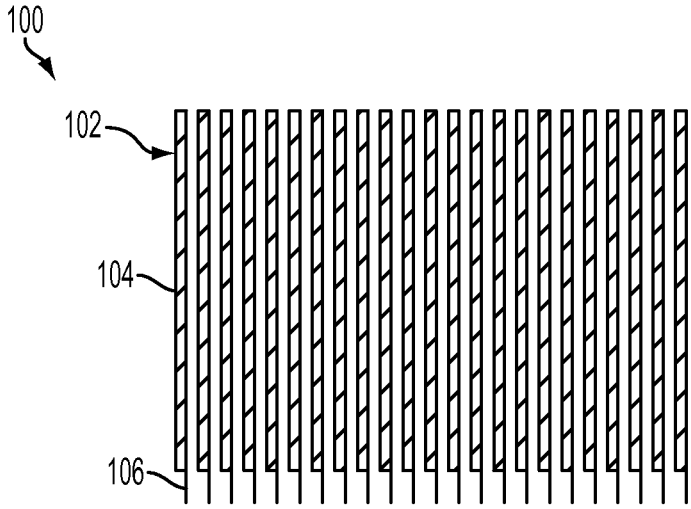
FIG. 1 is a test pattern for use with an improved missing inkjet detection method as disclosed herein.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces ink images on media, such as a digital copier, bookmaking machine, facsimile machine, a multi-function machine, or the like. As used herein, the term "process direction" refers to a direction of travel of an image receiving member, such as an imaging drum or print medium, and the term "cross-process direction" is a direction that is perpendicular to the process direction along the surface of the image receiving member. Also, the description presented below is directed to a system for operating an inkjet printer to print test patterns on an image drum or belt that more reliably enable missing inkjet detection. The reader should also appreciate that the principles set forth in this description are applicable to similar test pattern generators and digital image analyzers that may be adapted for use in any imaging device that generates images with dots of marking material.

Figure 4:
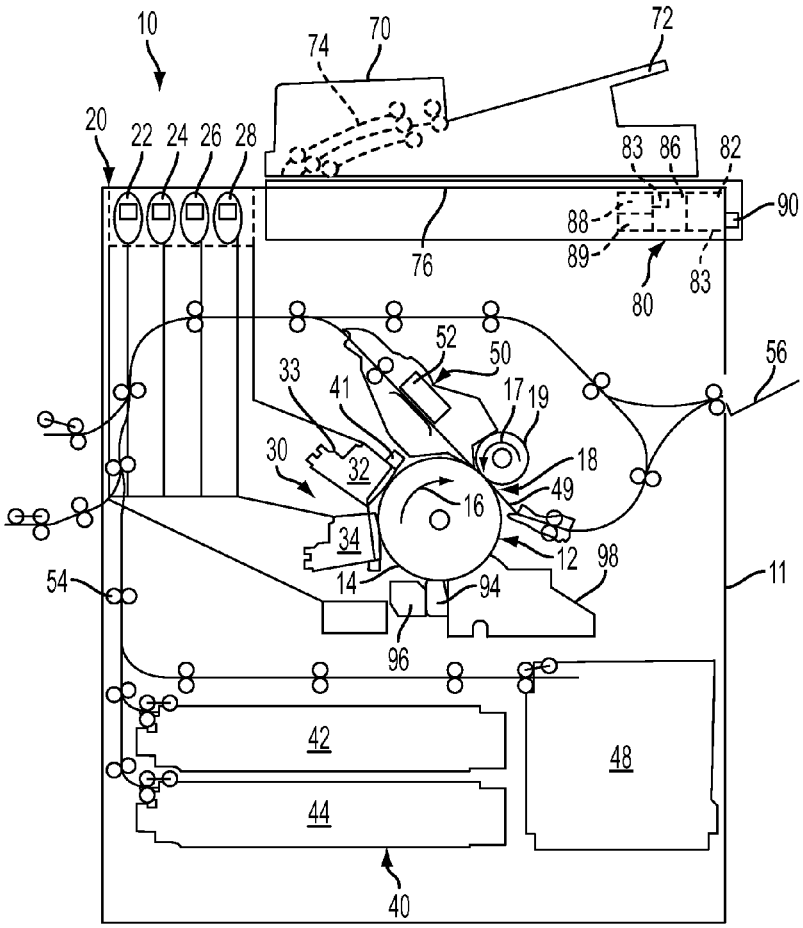
FIG. 4 is a block diagram of a prior art inkjet printing system in which the improved missing inkjet detection method may be used.

As shown in FIG. 4, a particular printer 10 includes a frame 11 to which are mounted directly or indirectly all of the operating subsystems and components of the printer 10, as described below. The printer 10 further includes a rotating intermediate image receiving member 12 that has an imaging surface 14 movable in the direction 16, and on which phase change ink images are formed. A transfix roller 19 rotatable in the direction 17 is loaded against the surface 14 of image receiving member 12 to form a nip 18, within which ink images formed on the surface 14 are transfixed onto a heated media sheet 49.

The printer 10 also includes a phase change ink delivery system 20 that has at least one source 22 of one color phase change ink in solid form. The printer 10 shown is a multicolor image producing machine. The ink delivery system 20 includes four (4) sources 22, 24, 26, 28, representing four (4) different colors CMYK (cyan, magenta, yellow, black) of phase change inks. The ink delivery system 20 also includes a melting and control apparatus (not shown) for melting or phase changing the solid form of the phase change ink into a liquid form. The phase change ink delivery system is suitable for supplying the liquid form to a printhead system 30 including at least one printhead assembly 32. The printer 10 shown is a wide format high-speed, or high throughput, multicolor image producing machine. The printhead system 30 includes multiple multicolor ink printhead assemblies 32, 34. In the embodiment illustrated, each printhead assembly includes a plurality of independent printheads.

As further shown, the printer 10 includes a substrate supply and handling system 40. The substrate supply and handling system 40, for example, can include sheet or substrate supply sources 42, 44, 48, of which supply source 48, for example, is a high capacity paper supply or feeder for storing and supplying image receiving substrates in the form of cut media sheets 49, for example. The substrate supply and handling system 40 also includes a substrate handling and treatment system 50 that has a substrate heater or pre-heater assembly 52. The substrate supply and handling system 40 further includes a media transport 54, such as media transport rollers, for moving media 49 through the printer 10 from the supply sources 42, 44, 48 to a discharge area 56. The printer 10 as shown can also include an original document feeder 70 that has a document holding tray 72, document sheet feeding and retrieval devices 74, and a document exposure and scanning system 76.

Operation and control of the various subsystems, components, and functions of the printer 10 are performed with the aid of a controller 80. The controller 80, for example, is a self-contained, dedicated mini-computer having a central processor unit (CPU) 82 with electronic storage 84, and a display or user interface (UI) 86. The controller 80, for example, includes a sensor input and control circuit 88 as well as a pixel placement and control circuit 89. In addition, the CPU 82 reads, captures, prepares, and manages the image data flow between image input sources, such as the scanning system 76, or an online or a work station connection 90, and the printhead assemblies 32, 34. As such, the controller 80 is the main multi-tasking processor for operating and controlling all of the other printer subsystems and functions.

The printer controller 80 further includes memory storage for data and programmed instructions. The controller 80 may be implemented with general or specialized programmable processors that execute programmed instructions. The instructions and data required to perform the programmed functions can be stored in memory associated with the processors or controllers. The processors, their memories, and interface circuitry configure the controllers to perform the functions, such as the test pattern generation and the digital image analysis, described more fully below. These components can be provided on a printed circuit card or provided as a circuit in an application specific integrated circuit (ASIC). Each of the circuits can be implemented with a separate processor or multiple circuits may be implemented on the same processor. Alternatively, the circuits can be implemented with discrete components or circuits provided in VLSI circuits. Also, the circuits described herein can be implemented with a combination of processors, ASICs, discrete components, or VLSI circuits.

Figure 5:
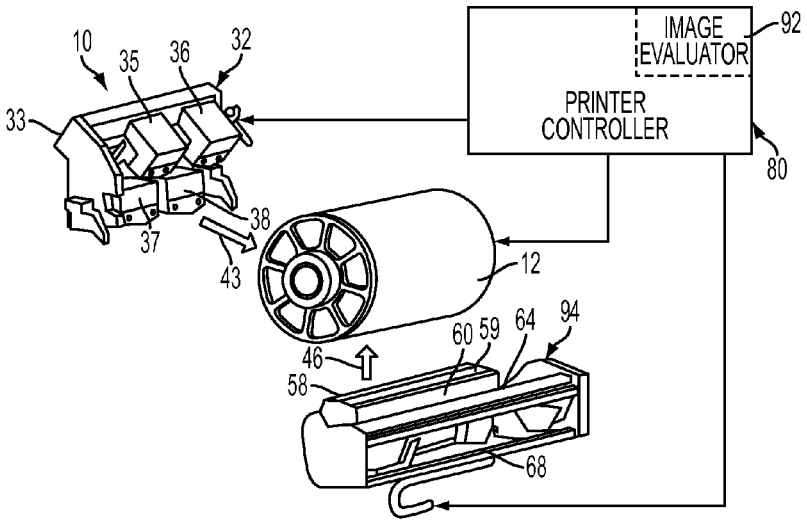
FIG. 5 is a schematic diagram of a printer depicting the components operated by a controller to improve identification of missing inkjets from digital images of test patterns on image receiving members.

Referring to FIG. 5, a schematic diagram of the printer 10 depicting the components operated by the controller 80 to identify missing and weak inkjets from a test pattern image on the image receiving member 12 is shown. The printhead assembly 32 includes four printheads 35, 36, 37, 38. Typically, each of these printheads ejects ink, indicated by arrow 43, to form an image on the image receiving member 12. The four printheads are arranged in a two by two matrix with the printheads in one row being staggered with reference to the printheads in the other row. Although the embodiment shown depicts a printhead assembly having four printheads, solid ink printers can have one or any number of any size printheads arranged in any practical manner.

Referring to FIGS. 4 and 5, the printheads 35, 36, 37, 38 of the printhead assembly 32 are operatively connected to a second support member 33 to position the printheads across a width of the image receiving member 12 that extends in the cross-process direction. To permit movement of the printheads 35, 36, 37, 38 across the image receiving member 12, the printer 10 further includes a second actuator 41 coupled to the second support member 33. The second actuator 41 is configured to move the second support member 33 transversely to the process direction to move the printheads in a cross-process direction across the width of the image receiving member 12.

The rotating intermediate image receiving member 12 can be a rotating drum, as shown in the figures, belt, or other substrate for receiving ink ejected from the printheads. Alternatively, the printheads can eject ink onto cut or continuous media 49 moving along a path adjacent to the printheads. To rotate or otherwise move the image receiving member 12, the printer 10 further includes an actuator 96 coupled to the image receiving member 12. Controlled firing of the inkjets in the printheads 35, 36, 37, 38 in synchronization with the rotation of the image receiving member 12 enables the formation of a single continuous horizontal bar across the width of the image receiving member 12. When occurring in synchronization with multiple consecutive rotations of the image receiving member 12, controlled firing of the inkjets and controlled actuation of the printhead assembly 32 in the cross-process direction enable a single inkjet to form a single continuous horizontal bar over different portions of the image receiving member 12. Similarly, controlled firing of the inkjets at a given frequency without actuation of the printhead assembly 32 enables a single inkjet to form a single continuous vertical bar extending in the process direction. Depending on the rotational speed of the image receiving member 12 and the firing frequency capability of the printheads, the vertical line can be formed in a single rotation of the image receiving member 12 or in multiple consecutive rotations of the image receiving member 12.

Referring still to FIGS. 4 and 5, the printer 10 also includes an image generator 94 to form a digital image of the ink image on the image receiving member 12. The image generator 94 includes a light source 58 for illuminating the image receiving member 12 and a plurality of electro-optical sensors 59. Each sensor 59 generates an electrical signal having an amplitude that corresponds to the intensity of the reflected light received by the sensor 59. These signals form the digital image of the ink image on the image receiving member 12. In one embodiment, the electro-optical sensors 59 are implemented in an integrated circuit. Each integrated circuit provides 432 electro-optical sensors 59. The image generator 94 has twelve integrated circuits that are linearly arranged in the cross-process direction to generate the digital image of the imaging member.

The light source 58 and electro-optical sensors 59 of the image generator 94 are operatively mounted to a first support member 60. In one embodiment, the first support member 60 is mounted on a bar 64 for reciprocating movement across the image receiving member 12 in the cross-process direction. In this embodiment, a first actuator 68, such as an electrical motor, is coupled to the first support member 60, through gear trains, translational, or rotational linkages or the like to move the first support member of the image generator 94 across the image receiving member 12 in response to a signal from the controller 80. The first actuator 68 is configured to respond to signals from the controller 50. Although the first support member 60 of this embodiment is configured for reciprocating movement across the image receiving member 12, other embodiments may use a fixed first support member.

Referring to FIG. 5, the controller 80 is coupled to the printhead assembly 32, the image receiving member 12, and the image generator 94 to synchronize the operation of these subsystems. To generate an image, the controller renders a digital image in a memory and generates inkjet firing signals and printhead actuation profiles from the digital image. The firing signals are delivered to the printheads 35, 36, 37, 38 in the assembly 32 to operate the inkjets to eject ink selectively. The actuation profiles are delivered to the second actuator 41 to control movement of the printhead assembly 32 in the cross-process direction. The controller 80 is coupled to the image receiving member 12 to control the rate and direction of rotation of the image receiving member 12. The controller 80 also generates signals to activate the image generator 94 for illumination of the image receiving member 12 and generation of a digital image that corresponds to the image on the member 12. The digital image is received by the controller 80 for storage and processing. A portion of the instructions executed by the controller 80 implement an image evaluator 92 that processes digital images of test patterns on the image receiving member 12 to detect weak and/or missing inkjets.

To improve the evaluation of the images being generated in one embodiment, the controller 80 executes programmed instructions that enable the printer 10 to operate the printheads 35, 36, 37, 38 and form an ink image with a substantially larger amount of ink than otherwise used for similar missing and/or weak inkjet detecting techniques. Because a larger amount of ink is used to form the test pattern, the controller 80 also executes the programmed instructions to transfer the test pattern to media, such as the media sheets 49, which are subsequently ejected from the printer 10 for disposal. The larger amount of ink in the test pattern enables missing inkjets to be detected more easily and the removal of the test pattern from the printer preserves the operational life of the drum maintenance unit. The processing of the scanned test pattern image enables the detection of missing and/or weak inkjets and the positioning of the electro-optical sensors 59 to image the test pattern for better analysis.

Figure 6:
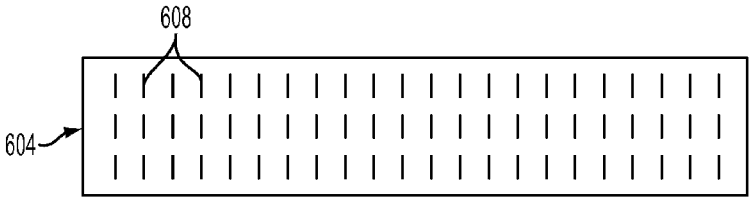
FIG. 6 is a portion of a test pattern useful for detecting missing inkjets.

A process for detecting missing and/or weak inkjets in a digital image of a test pattern is now described with reference to FIG. 6, FIGS. 7A and 7B, and FIGS. 8A and 8B. FIG. 6 shows a portion of a test pattern useful for detecting missing and/or weak inkjets. The test pattern 604 is comprised of a series of vertical dashes 608. Each dash is generated by a single inkjet ejecting a series of ink drops as the image receiving member 12 is rotated past a printhead. Thus, the portion of the test pattern 604 shown in FIG. 6 is generated by twenty-two inkjets. The amount of ink in typical test patterns, such as test pattern 604, is deliberately kept small since the test pattern is wiped from the image receiving member 12 and the ink is collected by a drum maintenance unit (98, FIG. 4).

Figure 7A:
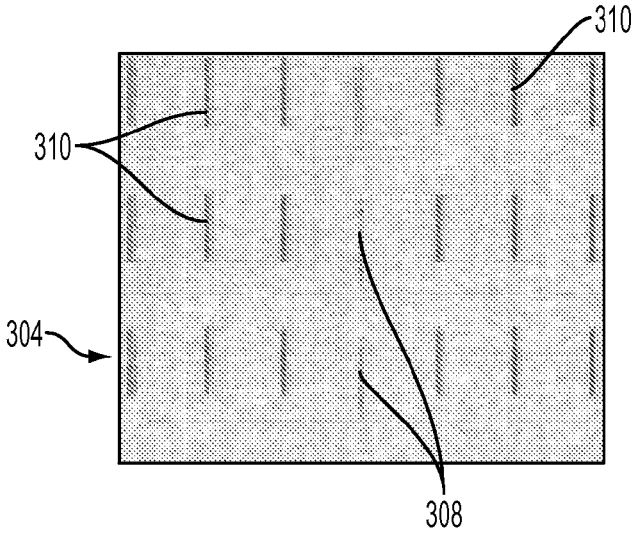
FIG. 7A is a portion of a digital image of a test pattern having evidence of a weak inkjet.
Figure 7B:
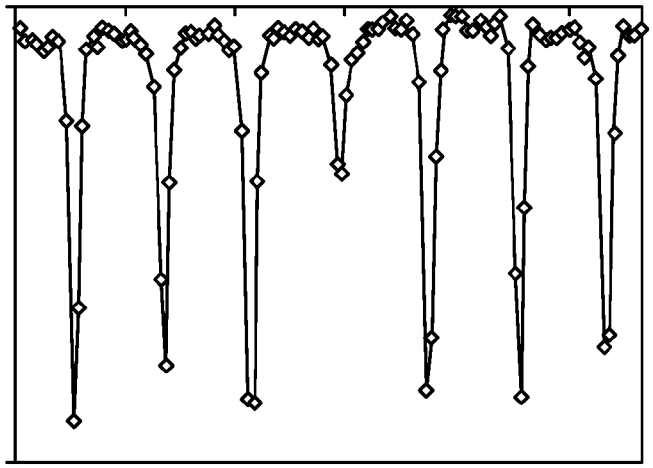
FIG. 7B is a profile of the data shown in the image of FIG. 7A.

In FIG. 7A, a portion of a test pattern 304 is shown with the dashes 308 in the pattern being generated by a weak inkjet. A "weak" inkjet is an inkjet that responds intermittently to a firing signal or that responds by ejecting ink drops having a mass that is less than the ink drop mass corresponding to the characteristics of the firing signal for the inkjet. The ink in the dashes 308 causes the image generator 94 to generate an electrical signal that has an amplitude that is closer to the amplitude for the signals generated for the areas of the image receiving member that do not have ink on them than the amplitudes for the signals generated for the other dashes 310. The amplitude differences and similarities of a digital image across test pattern 304 are shown in FIG. 7B. Similarly, the portion of the test pattern 404 shown in FIG. 8A has area 408 being generated by a missing inkjet where little or no ink was ejected by the inkjet. A "missing" inkjet is an inkjet that does not eject an ink drop or that ejects an essentially imperceptible amount of ink in response to a firing signal. A digital image across test pattern 404 yields the amplitude profile shown in FIG. 8B. As further used herein, a "missing" inkjet is an inkjet that has one or more of the characteristics of "weak" or "missing" inkjets as described above. An operable inkjet is an inkjet that does not exhibit any of the characteristics of a missing inkjet as now defined.

Figure 8A:
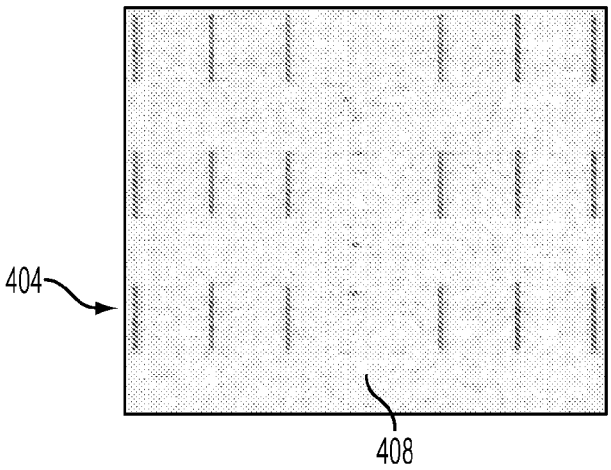
FIG. 8A is a portion of a digital image of a test pattern having evidence of a missing inkjet.
Figure 8B:
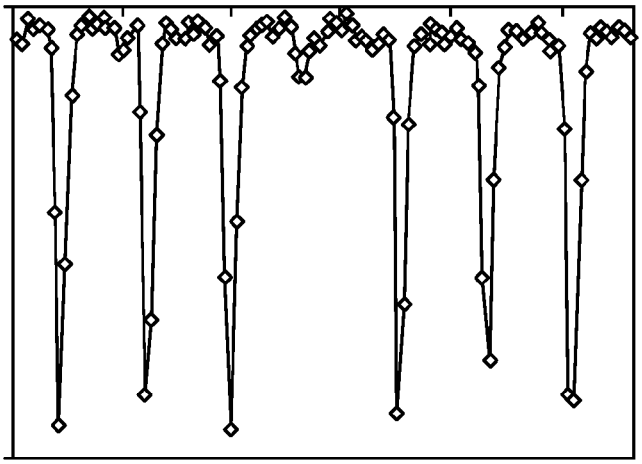
FIG. 8B is a profile of the data shown in the image of FIG. 8A.

The amplitude profiles generated by the image generator 94, such as those shown in FIGS. 7B and 8B, are used by the image evaluator 92 to detect missing inkjets. In one evaluation method, the amplitude of a profile curve for an inkjet is compared to a predetermined amplitude threshold to identify a missing inkjet from a test pattern. In another evaluation method, an area under a profile curve for an inkjet is integrated and compared to a predetermined area threshold to identify a missing inkjet from a test pattern. In yet another evaluation method, the amplitudes of the profiles and the areas under the profile curves are computed and compared to predetermined thresholds. In this method, both the amplitude and integration result must be greater than the predetermined thresholds before the inkjet is identified as being missing. Although the inkjet evaluation methods have been described with reference to amplitude and area comparisons, other evaluation methods and combinations of methods are possible.

Figure 2:
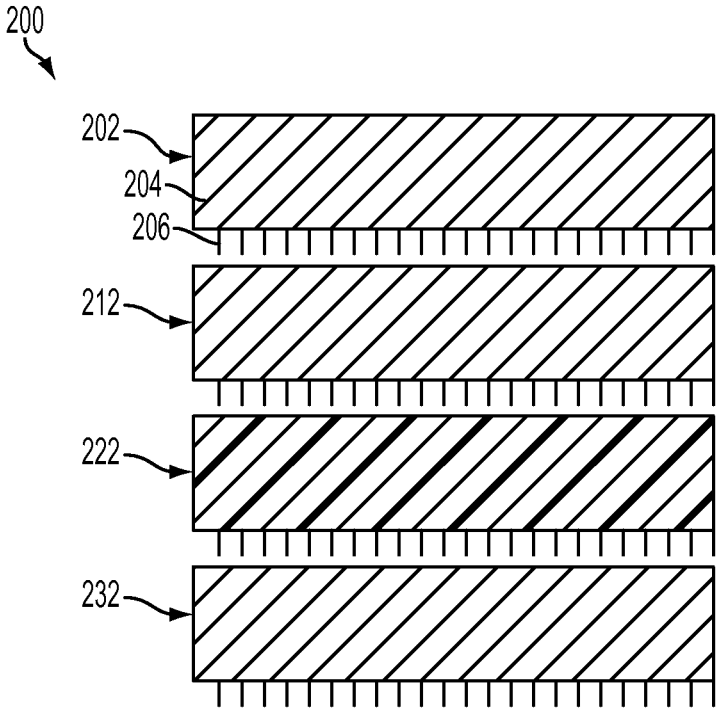
FIG. 2 is another test pattern for use with the improved missing inkjet detection method.

Exemplary test patterns for use with the improved missing inkjet detection method are shown in FIGS. 1 and 2. FIG. 1 shows a test pattern 100 useful for improving the reliability of detecting missing inkjets. The test pattern 100 includes a plurality of solid lines 102 with each line 102 having a mud portion 104 and a measurement portion 106. Each line 102 is formed on the image receiving member 12 by a single inkjet of a single printhead ejecting ink at the maximum frequency capability of the printhead. For example, the lines 102 of test pattern 100 are formed by twenty-three inkjets. The mud portion 104 is formed over multiple consecutive revolutions for a given length. The function of the mud portion is to eject a larger amount of ink than the amount of ink ejected in a typical detection pattern, such as the test pattern 604 shown in FIG. 6, and to stress the inkjets and exacerbate a missing inkjet failure condition. The measurement portion 106 is formed over one revolution of the image receiving member 12 with a length that extends past the mud portion 104. This measurement portion typically is formed on the last revolution on the trailing edge of the mud portion of the print in order to exercise the inkjet to the fullest extent. The image generator 94 generates digital image amplitude profiles of the measurement portion 106 for further processing by the controller 80 and the image evaluator 92. In one embodiment, the lines 102 of the test pattern 100 extend the entire length of a media sheet 49 for disposal of the ink after imaging. In another embodiment, the test pattern 100 extends for only a portion of the length of the media sheet 49.

FIG. 2 shows another test pattern 200 useful for improving the reliability of detecting missing inkjets on one or more printheads. To detect missing inkjets on multiple printheads, each printhead forms the test pattern 200 on a different portion of the image receiving member 12. To detect missing inkjets on a single printhead, the printhead can repeat the test pattern 200 on different portions of the image receiving member 12. The test pattern 200 includes a plurality of lines 202 with each line 202 having a mud portion 204 and a measurement portion 206. The mud portions 204 and measurement portions 206 are formed in a similar manner to the mud portions 104 and measurement portions 106 in test pattern 100; however, the mud portions 204 of the test pattern 200 are adjacent, giving the appearance of a single, continuous mud portion across the test pattern. The layout of the test pattern 200 enables generation of a plurality of lines 212, 222, 232 for each printhead in a printhead assembly. In the embodiment shown, the total length of the lines 202, 212, 222, 232 extends the entire length of a media sheet 49 for disposal of the ink after imaging.

Figure 3:
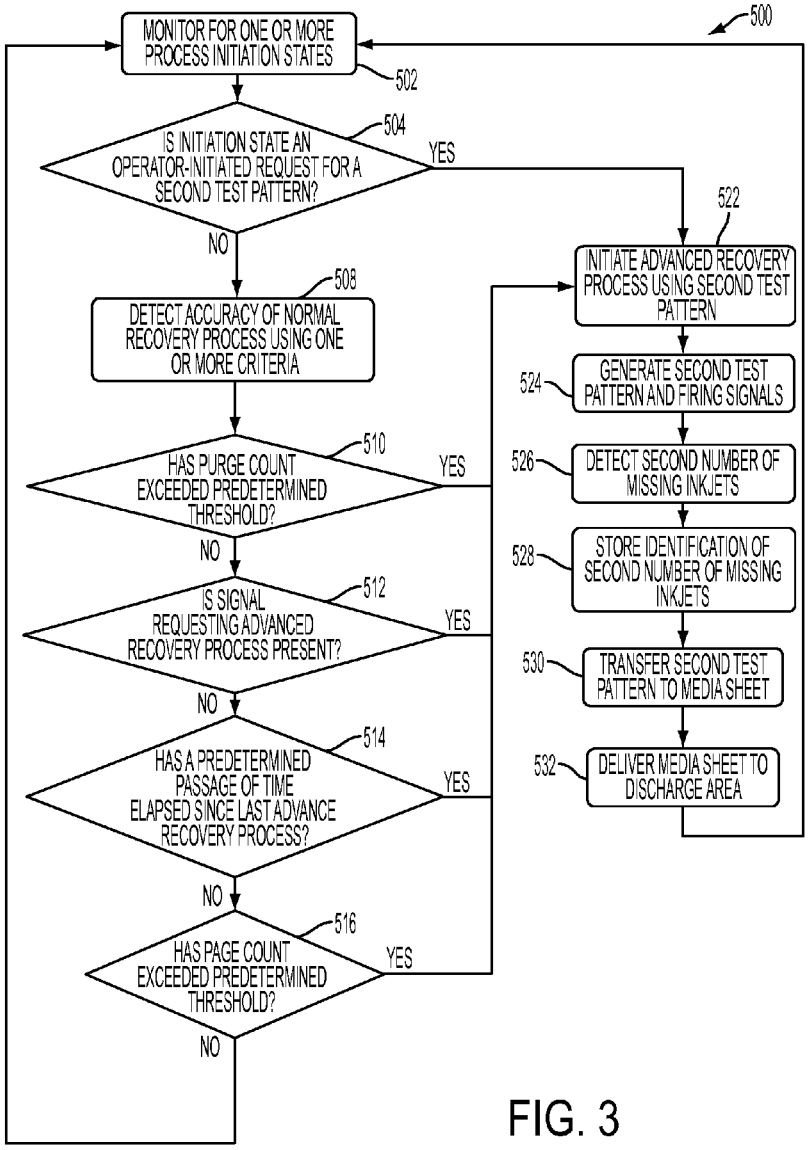
FIG. 3 is a flow diagram of the improved process for detecting missing inkjets from digital images of test patterns on image receiving members.

A process 500 for improving the detection of missing inkjets is shown in FIG. 3. The controller configured to execute the programmed instructions to implement the process 500 begins by monitoring the printer for one or more process initiation states (block 502), such as an operator-initiated request for an advanced recovery process or an operation of a normal recovery process. In the normal recovery process, the printer controller is configured with programmed instructions to print a first test pattern, such as pattern 604 as shown in FIG. 6, on the image receiving member. The instructions enable the image generator to generate digital images of the first test pattern and enable the image evaluator to analyze the digital images of the first test pattern to identify missing inkjets. During the life of the printer, the controller generates and images the first test pattern for analysis and detection of missing inkjets in accordance with a schedule or in response to manual activation by a user or a customer service technician. In the advanced recovery process, the printer controller is configured in the same manner as the normal recovery process, except that the programmed instructions direct the printer to print a second test pattern, such as the patterns 100 and 200 as shown in FIGS. 1 and 2. The operator-initiated request is a direct, manual activation of the advanced recovery process by the user or the customer service technician.

If the one or more process initiation states are detected, the controller configured to execute the programmed instructions to implement the process 500 determines whether the initiation state is an operator-initiated request or an operation of the normal recovery process (block 504). If the detected initiation state is an operator-initiated request for the advanced recovery process, the controller implementing the process 500 initiates the advanced recovery process (block 522). If the detected initiation state is not an operator-initiated request for the advanced recovery process, the initiation state is identified as the normal recovery process that uses the first test pattern to detect missing inkjets. Although the one or more process initiation states have been described with reference to an operator-initiated request for the advanced recover process or an operation of the normal recovery process, the process may monitor for other initiation states.

If the controller initiates the process 500 by operation of the normal recovery process, the controller configured to execute the programmed instructions to implement the process 500 continues by detecting that a first number of missing inkjets identified with reference to the first test pattern process is less than an actual number of missing inkjets in the printer (block 508). The detection of whether the first number of missing inkjets is less than the actual number of missing inkjets is accomplished by using one or more criteria to estimate the accuracy of the first number of missing inkjets as compared to the actual number of missing jets. The criteria selected to estimate the accuracy of the first number of missing inkjets are any criteria that indicate that the first number of missing inkjets is less than the actual number of missing inkjets. In one accuracy estimation method, repeated purges of at least one printhead are counted and stored in memory. If the purges counted within a predetermined period of time exceed a predetermined purge count threshold, the first number of missing inkjets detected with reference to the first test pattern is less than the actual number of missing inkjets (block 510). In another accuracy estimation method, the printer waits for the operation of the normal recovery process and monitors the printer for a signal requesting generation of the second test pattern of the advanced recovery process. The signal can be the result of a printer-initiated request for the advanced recovery process in response to a detected fault state within the printer or from an input from a customer or service technician possibly based on the quality of a printed (or reprinted) image. For instance, input can be required in response to a question generated and displayed by the printer. If after operation of the normal recovery process, the signal requesting generation of the advanced recovery process is detected, the first number of missing inkjets detected with reference to the first test pattern is less than the actual number of missing inkjets (block 512).

In yet another accuracy estimation method, the passage of time since a last generation of the second pattern of the advanced recovery process is monitored. If the passage of time since the last advanced recovery process exceeds a predetermined period of time, the first number of missing inkjets detected with reference to the first test pattern is less than the actual number of missing inkjets (block 514). In yet another accuracy estimation method, pages printed since a last generation of the second pattern of the advanced recovery process are counted. If the pages counted since the last advanced recovery process exceed a predetermined page count threshold, the first number of missing inkjets detected with reference to the first test pattern is less than the actual number of missing inkjets (block 516). If none of the criteria in the accuracy estimation methods are met, the controller configured to execute the programmed instructions to implement the process 500 continues to monitor for the one or more process initiation states (block 502). If any of the criteria in the accuracy estimation methods are met, the controller performing the process 500 initiates the advanced recovery process (block 522).

Process 500 is continued by operating the advanced recovery process to generate the second test pattern (block 524). The second test pattern is used to generate firing signals for the ejection of ink onto the image receiving member. The amount of ink ejected by inkjets onto the image receiving member during operation of the advanced recovery process is at least twice as much ink than each inkjet ejected to form the first test pattern of the normal recovery process. Moreover, printheads that are operated to form the second test pattern are operated at a frequency that could be greater than the frequency at which each inkjet operated to form the first test pattern of the normal recovery process (up to the maximum operational frequency of the print head).

The controller configured to execute the programmed instructions to implement the process 500 then detects a second number of missing inkjets with reference to a digital image of the second test pattern (block 526). To accomplish this detection, the image generator captures a digital image of the second test pattern on the image receiving member. The image evaluator generates an amplitude measurement, an area under a curve from the profile curve, or both for each inkjet in the digital image. The results are compared to appropriate predetermined thresholds for missing inkjets to determine whether the results indicate the inkjets are missing. If the results are less than the thresholds, the inkjets are identified as being missing inkjets and the process determines whether more results are to be processed. If the results for other inkjets have not been processed, then the process selects the next inkjet and generates the measurements from the inkjet profile. Once the results for all inkjets in the second test pattern are compared to the appropriate predetermined thresholds, the resulting missing inkjet identifications from the second test pattern are compared to the missing inkjet identifications from the first test pattern. Any missing inkjet identifications from the second test pattern that were not identified from the first test pattern are stored for additional processing (block 528).

To dispose of the ink ejected onto the image receiving member during operation of the advanced recovery process, the ink from the second test pattern is transferred to the media sheet (block 530). The controller operates a media transport to deliver a media sheet to a nip formed between the rotating image receiving member and a transfix roller to transfer the second test pattern from the rotating image receiving member to the media sheet. The controller continues to operate the media transport to deliver the media sheet with the transferred ink image of the second test pattern to a discharge area for disposal of the ink (block 532). After the media sheet is delivered to the discharge area, the process returns to monitor for the one or more process initiation states (block 502). The reader should note that the process described above can be used in an offset inkjet printer and in an inkjet printer that ejects ink directly onto cut media or onto continuous media.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for detecting missing inkjets in an inkjet printer comprising:

detecting with a controller a first number of missing inkjets identified with reference to a first test pattern is less than an actual number of missing inkjets in the inkjet printer;

operating with the controller each inkjet in at least one printhead in the printer at a frequency to generate a second test pattern in a process direction on a rotating image receiving member with each inkjet being operated to eject at least twice as much ink in the second test pattern than each inkjet ejected to form the first test pattern;

generating with an image generator having a plurality of light sensors arranged along a first support member a digital image of the second test pattern on the image receiving member from light reflected by the second test pattern and the image receiving member to the plurality of light sensors linearly arranged on the first support member that is transverse to the process direction;

detecting with the controller a second number of missing inkjets with reference to the generated digital image of the second test pattern received by the controller from the image generator; and storing with the controller an identification of the missing inkjets in the second number of missing inkjets that are not in the first number of missing inkjets detected with reference to the first test pattern to enable the controller to distribute image data corresponding to the missing inkjets in the second number of missing inkjets to operable inkjets in the printer.

2. The method of claim 1, the detection with the controller that the first number of missing inkjets identified with reference to the first test pattern is less than the actual number of missing inkjets in the inkjet printer further comprising:

counting with the controller purges of the at least one printhead; and detecting with the controller the first number of missing inkjets detected with reference to the first test pattern is less than the actual number of missing inkjets in the inkjet printer in response to the count of purges within a predetermined period of time exceeding a predetermined threshold.

3. The method of claim 1, the detection with the controller that the first number of missing inkjets identified with reference to the first test pattern is less than the actual number of missing inkjets in the inkjet printer further comprising:

detecting with the controller a signal requesting generation of the second test pattern.

4. The method of claim 1, the detection with the controller that the first number of missing inkjets identified with reference to the first test pattern is less than the actual number of missing inkjets in the inkjet printer further comprising:

detecting with the controller passage of a predetermined period of time since a last generation of the second test pattern.

5. The method of claim 1, the detection with the controller that the first number of missing inkjets identified with reference to the first test pattern is less than the actual number of missing inkjets in the inkjet printer further comprising:

counting with the controller pages printed since a last generation of the second test pattern; and detecting with the controller the first number of missing inkjets detected with reference to the first test pattern is less than the actual number of missing inkjets in the inkjet printer in response to the count of pages exceeding a predetermined threshold.

6. The method of claim 1 further comprising:

transferring by the controller operating a transfix roller the second test pattern from the rotating image receiving member to a media sheet; and operating a media transport with the controller to deliver the media sheet to a discharge area.

7. The method of claim 1, the operation of each inkjet in the at least one printhead with the controller further comprising:

moving with the controller operating an actuator operatively connected to a second support member to which the at least one printhead is mounted while operating each inkjet to eject ink to enable each inkjet to eject ink on a different portion of the image receiving member during multiple consecutive revolutions of the rotating image receiving member.

8. A method for detecting missing inkjets in an inkjet printer comprising:

detecting with a controller a first number of missing inkjets identified with reference to a first test pattern is less than an actual number of missing inkjets in the inkjet printer;

operating with a controller each inkjet in at least one printhead in the printer at a frequency to generate a second test pattern in a process direction on a rotating image receiving member with each inkjet being operated to eject at least twice as much ink in the second test pattern than each inkjet ejected in a first test pattern;

generating with an image generator having a plurality of light sensors arranged along a first support member a digital image of the second test pattern on the image receiving member from light reflected by the second test pattern and the image receiving member to the plurality of light sensors linearly arranged on a support member that is transverse to the process direction;

transferring the second test pattern from the rotating image receiving member to a media sheet by the controller operating a transfix roller; and operating a media transport with the controller to deliver the media sheet to a discharge area.

9. The method of claim 8 further comprising:

detecting with the controller a second number of missing inkjets with reference to the digital image of the second generated test pattern received by the controller from the image generator; and storing in a memory with the controller an identification of the missing inkjets in the second number of missing inkjets that are not in a first number of missing inkjets to enable the controller to distribute image data corresponding to the missing inkjets in the second number of missing inkjets to operable inkjets in the printer.

10. The method of claim 8, the operation of each inkjet in the at least one printhead with the controller further comprising:

moving with the controller operating an actuator operatively connected to a second support member to which the at least one printhead is mounted while operating each inkjet to eject ink to enable each inkjet to eject ink on a different portion of the image receiving member during multiple consecutive revolutions of the rotating image receiving member.

11. The method of claim 8 wherein the operation of each inkjet in the at least one printhead with the controller occurs in response to detection of an operator-initiated request for generation of the second test pattern.

* * * * *